US010224638B2

(12) United States Patent
Artemenko et al.

(10) Patent No.: US 10,224,638 B2
(45) Date of Patent: Mar. 5, 2019

(54) LENS ANTENNA

(71) Applicant: LIMITED LIABILITY COMPANY "RADIO GIGABIT", Moscow (RU)

(72) Inventors: Aleksey Andreevich Artemenko, Nizhniy Novgorod (RU); Andrey Viktorovich Mozharovskiy, Nizhniy Novgorod (RU); Vladimir Nikolaevich Ssorin, Nizhniy Novgorod (RU); Aleksey Gennad'evich Sevast'yanov, Nizhegorodskaya (RU); Roman Olegovich Maslennikov, Nizhniy Novgorod (RU)

(73) Assignee: LIMITED LIABILITY COMPANY "RADIO GIGABIT", Moscow (RU)

( * ) Notice: Subject to any disclaimer, the term of this patent is extended or adjusted under 35 U.S.C. 154(b) by 0 days.

(21) Appl. No.: 14/952,395

(22) Filed: Nov. 25, 2015

(65) Prior Publication Data

US 2016/0087344 A1 Mar. 24, 2016

Related U.S. Application Data

(63) Continuation of application No. PCT/RU2013/000429, filed on May 27, 2013.

(51) Int. Cl.
*H01Q 19/06* (2006.01)
*H01Q 15/08* (2006.01)
(Continued)

(52) U.S. Cl.
CPC ..... *H01Q 19/062* (2013.01); *H01Q 13/00* (2013.01); *H01Q 15/08* (2013.01); *H01Q 21/29* (2013.01)

(58) Field of Classification Search
CPC ..... H01Q 19/062; H01Q 15/08; H01Q 21/29; H01Q 13/10
(Continued)

(56) References Cited

U.S. PATENT DOCUMENTS 2,472,201 A * 6/1949 Eyges ..... H01Q 13/02 343/786
4,673,905 A * 6/1987 Yamawaki ..... H01Q 13/0225 333/239
(Continued)

OTHER PUBLICATIONS

International Search Report with regard to PCT/RU2013/000429 (dated Mar. 18, 2014).
(Continued)

*Primary Examiner* — Hai Tran
(74) *Attorney, Agent, or Firm* — Leason Ellis LLP

(57) ABSTRACT

Disclosed is a lens antenna comprising a dielectric lens consisting of a collimating part and an extension part, and an antenna element. The extension part of the lens comprises a substantially flat surface crossed by the axis of the collimating part, and the antenna element is rigidly fixed on the surface. The antenna element is formed by a hollow waveguide and comprises a dielectric insert with one end thereof adjacent to said surface; the size of the radiating opening of the waveguide is determined by the predefined width of the main beam and by side lobe levels of the radiation pattern of the lens antenna. The technical result of the invention is an increase in realized gain value due to the use of a waveguide antenna element with a dielectric insert, which provides impedance matching in a wide frequency bandwidth. The present invention can be used in radio-relay point-to-point communication systems, e.g. for forming backhaul networks of cellular mobile communication, in car radars and other
(Continued)

radars, in microwave RF tags, in local and personal communication systems, in satellite and intersatellite communication systems, etc.

18 Claims, 9 Drawing Sheets

(51) Int. Cl.
*H01Q 13/00* (2006.01)
*H01Q 21/29* (2006.01)

(58) Field of Classification Search
USPC ..... 343/753, 911 R, 786; 385/15
See application file for complete search history.

(56) References Cited

U.S. PATENT DOCUMENTS 4,792,808 A * 12/1988 Hildebrand ..... H01Q 21/205 343/754
5,706,017 A 1/1998 Buettgenbach
6,133,880 A * 10/2000 Grangeat ..... H01P 5/08 343/700 MS
6,590,544 B1 * 7/2003 Filipovic ..... H01Q 15/08 343/700 MS
6,859,187 B2 2/2005 Ohlsson
2002/0164951 A1 * 11/2002 Slaughter ..... H01Q 1/125 455/39
2003/0179148 A1 * 9/2003 Ohlsson ..... G01F 23/284 343/786
2008/0284655 A1 11/2008 Alamouti et al.
2009/0153421 A1 * 6/2009 Rofougaran ..... H01Q 1/2283 343/745
2010/0328779 A1 12/2010 Llombart et al.

OTHER PUBLICATIONS

Artemenko, Alexey et al., "Millimeter-Wave Electronically Steerable Integrated Lens Antennas for WLAN/WPAN Applications", IEEE Transactions on Antennas and Propagation, IEEE Service Center, Piscataway, NJ, US, vol. 61, No. 4, Apr. 1, 2013, pp. 1665-1671.
Fernandes, C. A. et al., "Shaped Coverage of Elongated Cells at Millimetre Waves Using a Dielectric Lens Antennas", Proceedings of the 25th. European Microwave Conference 1995. Bologna, Sep. 4-7, 1995; [Proceedings of the European Microwave Conference], Swanley, Nexus Media, GB, vol. CONF. 25, Sep. 4, 1995, pp. 66-70.
Pohl, N., "A Dielectric Lens Antenna with Enhanced Aperture Efficiency for Industrial Radar Applications", Antennas and Propagation (MECAP), 2010, IEEE Middle East Conference on, IEEE, Oct. 20, 2010, pp. 1-5.
Karttunen A. et al., "Reduction of Internal Reflections in Integrated Lens Antennas for Beam-Steering," Progress in Electromagnetics Research, vol. 134, 2013, pp. 63-78.
Dou W. B. et al., "Ray Tracing on Extended Hemispherical and Elliptical Silicon Dielectric Lenses," International Journal of Infrared and Millimeter Waves, vol. 16, 1995, pp. 1993-2002, No. 1L.

* cited by examiner

LENS ANTENNA

CROSS-REFERENCE

The present application is continuation of PCT/RU2013/000429 filed on May 27, 2013, entitled "LENS ANTENNA", the entirety of which is incorporated herein by reference.

FIELD OF THE INVENTION

The present invention relates to antenna engineering, more particularly to novel lens antennas used in various applications of millimeter wave radio communication systems, such as radio-relay point-to-point communication systems and backhaul networks of mobile cellular communications, radars, satellite and intersatellite communication systems, local and personal communication systems, etc.

BACKGROUND ART

The demand for data throughput growth leads to increasingly widespread use of various radio communication systems operating in the millimeter wave range. Such increase is associated, on the one hand, with a wide frequency bandwidth available for use in said range, and on the other hand, with significant technological advances made over the past few decades, allowing to create modern, effective and cost-efficient (in terms of large-scale production) transceivers operating in frequency ranges from 30 GHz to over 100 GHz. Modern millimeter wave radio communication systems include, without limitation, radio-relay stations providing point-to-point and point-to-multipoint communications, car radars, wireless local area communication networks, etc.

The effectiveness of millimeter wave communication systems is determined largely by characteristics of antennas used in said systems. Such antennas generally should have a high gain value, and consequently, should form a narrow radiation pattern beam. In this case, the antennas provide effective (i.e. with maximum throughput) signal transmission over long distances, but said antennas also require precise alignment of narrow beams between two radio communication stations.

The requirement for high gain value is determined by a small wavelength of radiation in said frequency range, which leads to difficulties in transmitting a signal over long distances using antennas with insufficient gain values. Furthermore, in said frequency range, the effect of weather conditions and atmospheric absorption is high (e.g., in the frequency range of about 60 GHz, the effect of oxygen spectral line absorption is high, leading to additional signal attenuation at 11 dB/km).

Known configurations of millimeter wave antennas providing high gain include antenna arrays (including slot antenna arrays implemented in a metal waveguide), reflector antennas (e.g., parabolic and Cassegrain antennas), various types of lens antennas (e.g. thin lenses with separated feed, Fresnel lenses, Luneburg lenses, artificial lenses from a reflect arrays). In order to provide a high gain value, the dimensions of radiating aperture in all such antennas greatly exceed the operating wavelength. A review of various aperture antenna configurations can be found, e.g., in Y. T. Lo, S. W Lee, Antenna Handbook. Volume II: Antenna Theory, Springer, 1993, pp. 907.

Advances in aperture antenna technology are directed at several areas. On the one hand, high gain value is provided easily by enlarging the radiating aperture, which primarily requires improving the precise manufacturing technology of reflector antennas mirrors, lenses and other secondary focusing devices of large sizes. On the other hand, when using a fixed aperture size, the increase in gain value is provided by increasing the aperture efficiency of the antenna, by improving impedance matching, and by increasing the radiation efficiency. For that purpose, a diversity of new and improved aperture antenna arrangements has been developed.

The increase in gain value of an aperture antenna is generally provided by forming a more effective amplitude-phase distribution at the equivalent aperture of the antenna. For example, in horn-lens antennas, it can be accomplished by inserting a dielectric lens into the horn that allows providing flat wave front of the radiation. One of the embodiments of a horn-lens antenna is disclosed, in particular, in U.S. Pat. No. 6,859,187. However, despite the fact that said antennas provide an increase in gain value, they are quite large (i.e. axially large), difficult to manufacture, and consequently, expensive to produce.

Therefore, in the new aperture millimeter wave antenna structures, it is important to provide ease of implementation and installation, as well as a wide radiation frequency band. One of the most promising antenna types that provides high gain value in wide frequency range and has a simple construction is a lens antenna with an integrated antenna element (see, e.g., W. B. Dou and Z. L. Sun, "Ray Tracing on Extended Hemispherical and Elliptical Silicon Dielectric Lenses," International Journal of Infrared and Millimeter Waves, Vol. 16, pp. 1993-2002, No. 1L, 1995, and A. Karttunen, J. Ala-Laurinaho, R. Sauleau, and A. V. Raisanen, "Reduction of Internal Reflections in Integrated Lens Antennas for Beam-Steering," *Progress In Electromagnetics Research*, Vol. 134, pp. 63-78, 2013).

A lens antenna with an integrated antenna element is known from U.S. Pat. No. 5,706,017, titled "Hybrid Antenna Including a Dielectric Lens and Planar Feed". The increase in gain value in such antenna is provided by using a lens of a specific shape, said lens focusing the radiation in a certain spatial direction from the primary antenna element that is installed in the focal plane on the surface of the lens. The shape of the collimating part of the lens is calculated directly from the dielectric properties thereof, in particular, from the dielectric constant ($\in>1$). The canonical shape of the collimating part of the lens in the disclosed antennas is a hemiellipsoid of revolution or a hemisphere. A non-collimating part of the lens is formed as an extension having various shapes and required dimensions. In this device, the object of precisely positioning the antenna element with respect to the lens focus is further achieved by placing the primary antenna element directly on the flat surface of the lens, thus providing simplicity of design and assembly of the antenna.

The lens antenna disclosed in U.S. Pat. No. 5,706,017 provides beam scanning by using an array of switchable primary antenna elements. This is made possible due to the property of the lens antenna allowing for angular deflection of the beam with respect to the axis of the lens when the primary antenna element is displaced along the flat surface of the lens, on which said antenna element is placed. Beam scanning is used for simplification and automation of beam adjustment in radio-relay point-to-point communication systems, which is a crucial objective in developing aperture antennas due to the very narrow beam of the radiation pattern.

The lens antenna 1 of U.S. Pat. No. 5,706,017 is shown in FIG. 1. Generally, the lens antenna 1 comprises a lens 2 and an antenna element 3, which is a primary antenna element. The lens 2 consists of a collimating part 4 and an extension part 5. The collimating part 4 is integrally formed with the extension part 5, and the parts 4 and 5 of the lens 2 are made of a dielectric material. The collimating part 5 of the lens 2 comprises a substantially flat surface 6 crossed by the axis of the collimating part 4 of the lens 2, and the antenna element 3 is rigidly fixed on the surface 6. The advantages of such antenna include easy and low-cost manufacturing, as well as convenient assembly and positioning of the primary antenna element 3 at a certain position with respect to the focus of the lens 2.

In order to focus the radiation from the primary antenna element 3 in a certain direction, the collimating part 3 of the lens 2 has an elliptic (or quasi-elliptic) shape with eccentricity inversely proportional to the refraction index of the lens material. The extension part 5 of the lens can have various shapes, e.g. a cylindrical shape with thickness equal to the focal length of the ellipsoid of revolution. If the required antenna diameter is small, the lenses can have modified shapes, e.g. hemispherical shape, hyperhemispherical shape, or elliptic shape with modified eccentricity.

In the lens antenna of U.S. Pat. No. 5,706,017, the primary antenna element is a planar log-spiral antenna. The advantages of such antenna include a wide frequency bandwidth and the possibility of connection a detector element between the antenna arms. However, the directivity of the spiral antenna is defined by the size thereof, which is calculated based on bandwidth requirements. This leads to difficulties in optimizing directivity of the spiral antenna for effective illumination of a dielectric lens of a specific geometry, and consequently, to difficulties in maximizing directivity of the whole lens antenna. Furthermore, such antenna is rather sensitive to imperfections during manufacturing and has quite large back-to-front radiation ratio when installed on the lens.

In some known lens antenna devices with certain types of planar integrated antenna elements, improvements are directed towards increasing gain value by special modifications of the lens shape.

Said object was addressed, e.g., in the antenna of U.S. Pat. No. 6,590,544, titled "Dielectric Lens Assembly for a Feed Antenna". The lens antenna of U.S. Pat. No. 6,590,544 comprises a dielectric lens with a collimating part and an extension part, the collimating part and the extension part formed of a dielectric material, wherein the extension part comprises a substantially flat surface crossed by the axis of the collimating part, with at least one antenna element mounted on said surface, wherein the extension part of the lens consists of a plurality of dielectric substrates (see FIG. 2). The increase in directivity for a certain primary antenna element in such lens antenna is provided by selecting thicknesses and number of dielectric substrates, of which the extension part is comprised. The lens antenna of U.S. Pat. No. 6,590,544 is the closest prior art for the present invention.

However, the selection of lens extension length described in U.S. Pat. No. 6,590,544 is valid only for a specific primary antenna element. If the structure of the antenna element is changed, the selected thickness value will not be optimal. Therefore, the obtained optimal position of one antenna element is ineffective for another antenna element (having different radiation pattern properties in the lens body). In the invention of U.S. Pat. No. 6,590,544, antenna elements formed by two slots, spiral antennas, and an oscillating dipole with triangular arms are used. It is apparent that in order to maximize directivity of the lens antenna while using each of said antenna elements, the thickness and number of layers in the extension part of the lens may vary.

Furthermore, the lens antenna structure disclosed in U.S. Pat. No. 6,590,544 and other solutions described hereinabove, can be effectively used only in such millimeter wave communication systems where the required lens size is smaller than 10× wavelength in free space. For larger diameter lenses it can be shown that any modifications in the lens shape (with respect to the canonical hemielliptic with extension length equal to the lens focus) cause phase distortions in the field distribution on an equivalent circular aperture, leading to a change in signal phase in the peripheral areas of the aperture to the opposite value. This leads to a significant degradation of the lens antenna directivity. Therefore, in order to form lens antennas having a diameter of over 10×-20× wavelength in free space, lenses of standard hemielliptic shape with determined extension length (equal to the focal length of the lens) must be used. In this case, the use of antenna structure disclosed in U.S. Pat. No. 6,590,544 to maximize directivity becomes ineffectual.

Also an electronically steerable integrated lens antenna is disclosed in Alexey Artemenko et al., "Millimeter-Wave Electronically Steerable Integrated Lens Antennas for WLAN/WPAN Applications", IEEE Transactions on Antennas and Propagation, vol. 61, no. 4, 1 Apr. 2013, pp. 1665-1671. The electronically steerable integrated lens antenna includes an extended hemispherical lens, four switched aperture coupled microstrip antenna elements, and a distribution circuit. There is also no possibility to increase lens antenna directivity since an array of standard microstrip patch antenna elements are used.

Further, US 2008/284655 A1 discloses a semiconductor antenna having antenna elements and a switching network formed in the same semiconductor die and configured to control activation of the antenna elements. Though the antenna elements are realized on a semiconductor die they have the same microstrip patch structure that cannot be configured to provide optimal lens illumination and, thus, maximum directivity and gain.

Furthermore, a dielectric lens antenna fed directly by the open end of a waveguide having a dielectric wedge is known form Fernandes C. A. et al., "Shaped Coverage of Elongated Cells at Millimetre Waves Using a Dielectric Lens Antennas", Proceedings of the 25th. European Microwave Conference 1995. Bologna, Sep. 4-7, 1995, pp. 66-70. This document discloses the use of a hollow waveguide served at the same time as a feed waveguide. In this case the radiating opening of the waveguide is not capable to be optimized to have optimal illumination of the lens internal surface by incident electromagnetic waves that is caused by the fact that the feed waveguide cross-section size should be predetermined so to provide propagation of only one TE10 mode of the electromagnetic field. In that sense the feed waveguide is not effective and cannot be adapted to optimally illuminate lenses made of different dielectrics.

Therefore, it is an object of the present invention to increase directivity of a lens antenna when using lenses of any diameter, including large (>20× wavelength) diameters. It is another object of the present invention to provide high radiation efficiency and to improve impedance matching level in the lens antenna device. Achieving of said objects results in increasing the realized gain value of the lens antenna, and thus in increasing the effectiveness of millimeter wave communication systems.

SUMMARY OF THE INVENTION

The lens antenna according to the invention (similar to the closest prior art) comprises a lens and an antenna element, the lens including a collimating part and an extension part, the collimating part and the extension part being formed integrally from a dielectric material, wherein the extension part comprises a substantially flat surface crossed by an axis of the collimating part; wherein the antenna element is rigidly fixed on said surface, characterized in that the antenna element is formed by a hollow radiating waveguide with a radiating opening thereof facing the lens, wherein the hollow radiating waveguide comprises transition segment between an input aperture of the hollow radiating waveguide and the radiating opening, the transition segment having a variable cross section; and the antenna element comprises a dielectric insert having the same cross-section shape as the radiating opening, wherein the dielectric insert and the dielectric lens are formed of the same material, and the dielectric insert is formed integrally with the lens.

In the lens antenna according to the invention, the dielectric lens focuses the radiation from the antenna element in a certain direction, thus forming a narrow beam of the radiation pattern. The flat surface is used for mounting the antenna element thereon, thus providing simplicity in positioning the antenna element in the focal plane in a defined position with respect to the axis of the lens.

The increased gain value in the lens antenna according to the invention is achieved by forming the antenna element as a hollow waveguide mounted on the flat surface of the dielectric lens. Inserting a dielectric insert into the waveguide of the antenna element in the lens antenna according to the invention provides the required impedance matching level in a wide frequency band, which amplifies the effect of the increase of the realized antenna gain value. Said insert is placed adjacent to the flat surface of the lens, thus providing a transition area between the waveguide and the lens. The lens antenna according to the invention further provides high radiation efficiency due to the fact that the antenna element is formed by a hollow metal waveguide, and therefore, losses are low when a millimeter wave signal is propagated in the antenna element.

Forming the dielectric insert and the dielectric lens of the same material and forming the dielectric insert integrally with the lens allows implementing the lens antenna more easily, because no mechanical attachment of the insert onto the flat surface of the lens or into the waveguide is needed.

According to one embodiment, the radiating opening of the radiating waveguide is configured such that its size defines a beamwidth value of a main lobe and side lobe levels of the radiation pattern of the lens antenna. Variations in size and shape of the radiating opening of the antenna element allow controlling illumination of the collimating part of the lens, and therefore, providing the required electromagnetic field distribution on the equivalent circular aperture of the lens, which forms the lens antenna radiation pattern having predetermined beam shape and width. Thus, when the size of the radiating opening of the waveguide is increased, the antenna element provides more directive radiation in the lens body, and therefore, only the central area of the collimating part of the lens is effectively illuminated. This leads to a reduction in size of the equivalent circular aperture of the lens antenna, and consequently, to an increased beam width and a decrease of side lobe levels of the radiation pattern. If the size of the radiating opening of the waveguide is small (~$\lambda/3$–$\lambda$, where $\lambda$ is the wavelength in free space), the antenna element forms a wider radiation pattern in the lens body, which leads to a decreased beam width and an increase in side lobe levels of the lens antenna radiation pattern. In an exemplary case, the required shape and width of the main radiation pattern lobe and side lobe levels can be selected in such way that the maximum directivity of the lens antenna is achieved.

According to another embodiment, the lens antenna is adapted to control the direction of the main radiation pattern beam by placing the antenna element on the lens surface in various positions with respect to the axis of the lens. This is possible due to the beam deflection property of lens antennas depending on the displacement of the antenna element with respect to the axis of the lens.

According to one embodiment, the cross-section shape of the dielectric insert corresponds to the shape of the radiating opening of the waveguide. Such structure provides the simplest way to achieve the required impedance matching level in a wide frequency bandwidth.

In one embodiment, the length of the dielectric insert is less than the radiating waveguide length, which allows for simple insert installation into the waveguide and for effective connection to external waveguide devices (e.g., a transceiver).

According to another embodiment, the radiating opening of the radiating waveguide has a rectangular shape. In this embodiment, the lens can be made of a material with the dielectric constant ranging from 2.0 to 2.5, while the length of each side of the radiating opening of the radiating waveguide is selected from a range of 0.6$\lambda$-1.0$\lambda$, where $\lambda$ is the wavelength in free space, in order to increase directivity.

According to yet another embodiment, the radiating opening of the radiating waveguide has a circular shape. In this embodiment, the lens can be made of a material with the dielectric constant ranging from 2.0 to 2.5, while the diameter of the radiating opening of the radiating waveguide is selected from a range of 0.6$\lambda$-1.0$\lambda$, where $\lambda$ is the wavelength in free space, in order to increase directivity.

According to yet another embodiment, the radiating opening of the radiating waveguide has an elliptic shape. In this embodiment, the lens can be made of a material with the dielectric constant ranging from 2.0 to 2.5, while the minor and major semi-axes of the elliptic radiating opening of the radiating waveguide are selected from a range of 0.6$\lambda$-1.0$\lambda$, where $\lambda$ is the wavelength in free space, in order to increase directivity.

In yet another embodiment, the collimating part of the lens has a shape of a hemi-ellipsoid of revolution. In another embodiment, the collimating part of the lens has a hemispherical shape. According to one embodiment, surface of the extension part is a surface of revolution, having e.g. a cylindrical or truncated conical shape. Truncated conical shape of the extension part of the lens allows decreasing lens weight and provides the possibility of locating antenna elements on the surface placed at an angle other than 90° to the axis of the lens.

According to yet another embodiment, a non-radiating opening of the waveguide is connected to a transceiver for receiving/transmitting and processing a data signal. Further, in one embodiment, a certain transition segment (stepwised or smoothed) is used between the cross-section of the waveguide of the primary antenna element and the cross-section of the waveguide interface of the transceiver. This embodiment of the lens antenna allows an easy connection between the antenna element and the transceiver.

Also disclosed is lens antenna comprising: a lens and at least two antenna elements, the lens including a collimating part and an extension part, the collimating part and the extension part being formed integrally from a dielectric material, wherein the extension part comprises a substantially flat surface crossed by the axis of the collimating part; wherein the at least two antenna elements are rigidly fixed on said surface, characterized in that the antenna elements are formed by hollow radiating waveguides with radiating openings thereof facing the lens, wherein each of the hollow radiating waveguides comprises a transition segment between an input aperture of the hollow radiating waveguide and the radiating opening, the transition segment having a variable cross section, and each of the antenna elements comprises a dielectric insert having the same cross-section shape as its radiating opening, wherein the dielectric inserts and the dielectric lens are formed of the same material, and the dielectric inserts are formed integrally with the lens.

According to one embodiment, the lens antenna further comprises a switching unit for supplying a signal to one of at least two antenna elements. In this embodiment, the lens antenna allows for electronic beam scanning, which can be effectively used for automatic alignment of the antenna or for adjusting the beam during operation.

Further features and advantages of the present invention will become apparent from the following description of the preferred embodiments with reference to accompanying drawings. Similar elements in the drawings are denoted by similar reference numerals.

DETAILED DESCRIPTION OF THE INVENTION

Figure 1:
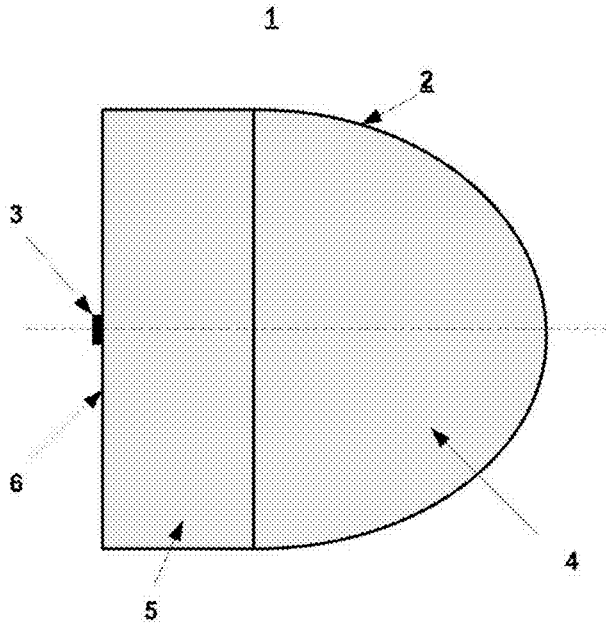
Prior Art Fig. 1
FIG. 1 shows a general structure of a lens antenna with an antenna element mounted on the flat surface thereof (background art).
Figure 2:
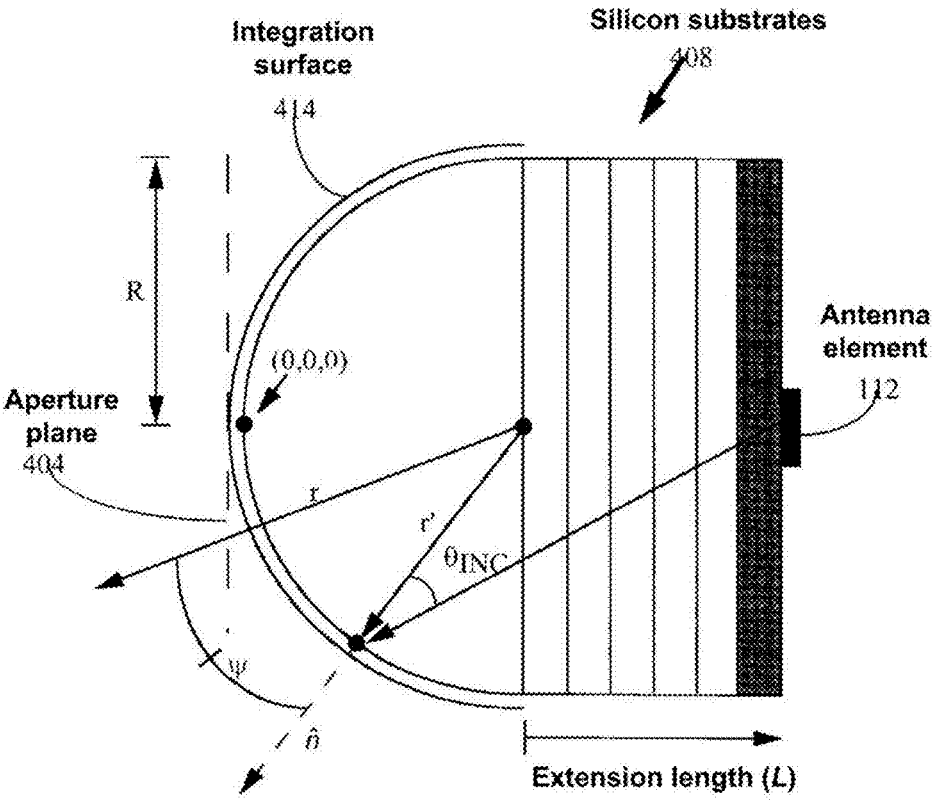
Prior Art Fig. 2
FIG. 2 shows the structure of a lens antenna, wherein the extension part of the lens consists of a plurality of dielectric layers (background art).
Figure 3:
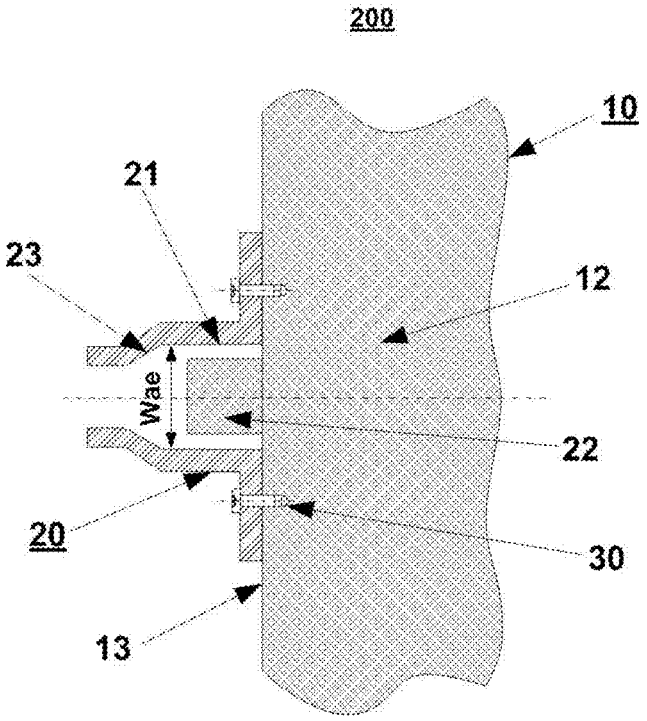
FIG. 3 illustrates an embodiment of a lens antenna in accordance with the present invention.

According to the invention, it is provided an increased gain value in lens antennas having large diameters (over 10×-20× wavelength in free space, which is required for use in radio-relay millimeter wave point-to-point communications). An example of a lens antenna 200 according to one of the embodiments is shown in FIG. 3. The antenna 200 comprises a lens 10 and an antenna element 20, which is a primary antenna element. The lens 10 consists of a collimating part 11 and an extension part 12. The part 11 is integrally formed with the part 12, and the parts 11 and 12 of the lens 10 are made of a dielectric material. The antenna element 20 is formed by a hollow waveguide 21 with a transition segment 23 between the input aperture and the radiating opening facing the lens, said radiating opening having width Wae and comprising a dielectric insert 22. The part 12 of the lens 10 comprises a substantially flat surface 13, and the antenna element 20 is rigidly fixed on the surface 13 by means of screws 30.

As mentioned above, the hollow waveguide 21 includes the radiating opening facing the flat surface 13 of the lens 10, and thus the hollow waveguide 21 can be also called as a radiating waveguide throughout the present description.

Due to a predetermined size of the radiating opening 21 fixed on the surface 13 of lens 10, the lens antenna 200 according to the invention provides control of the antenna element radiation pattern characteristics formed inside the body of the lens 10 that allows increasing directivity of the lens antenna.

A further advantage of said embodiment of the lens antenna is the possibility of feeding signal using waveguides of any (including standard) sizes due to forming said waveguides integrally with the antenna element 20 by means of the transition segment 23 having a variable (including, in some cases, step-wise) cross-section.

In the lens antenna 200 according to the invention, the dielectric insert 22 in the antenna element 20 compensates discontinuity of the waveguide/dielectric space boundary, which inhibits the transmission of a millimeter wave electromagnetic signal. If no insert 22 is used, said discontinuity causes high reflection coefficient value, thus decreasing the realized gain of the antenna. Compensating of said discontinuity by including the insert 22 into the structure of the lens antenna 200 increases the gain value and improves impedance matching level. Said insert 22 with certain geometric parameters and dielectric constant value provides smooth electromagnetic field transformation, which significantly reduces the waveguide/dielectric space discontinuity in a wide frequency bandwidth. The insertion of the dielectric insert 22 into the lens antenna does not significantly change radiation pattern width of the primary antenna element 20, said width substantially defined only by the size of the radiating opening of the waveguide 21 and by the material of the lens 10. This allows maximizing the directivity and separately minimizing the reflection coefficient.

To effectively decrease the reflection coefficient, the shape, size and thickness of the dielectric insert 22 must be selected appropriately. Herewith, said parameters can be different for various dielectric constant values of the material of the insert 22. In one embodiment, the insert 22 can be made of the same material as the lens 10. In one preferred embodiment, the cross-section of the dielectric insert 22 has the same shape as the radiating opening of the waveguide 21. Further, the shape of the longitudinal section of the insert 22 can be rectangular, triangular, trapezoidal or any other shape.

In order to provide certain properties of the radiation pattern of the lens antenna, various shapes of the radiating opening of the waveguide 21 can be used. In particular examples, said shape can be rectangular, circular or elliptical. When length of the dielectric insert 22 is less than length of the waveguide 21 of the antenna element 20, such structure provides easy manufacturing and assembly in addition to impedance matching. The use of various shapes of the radiating opening of the waveguide is effective when receiving or radiating electromagnetic waves with various polarizations. For example, a rectangular opening is used for receiving and/or radiating a signal with a linear or two orthogonal linear polarizations. A circular opening receives or transmits signals with any polarizations, including circular or elliptic polarizations.

In different embodiments, the antenna element 20 can be attached to the surface 13 of the lens 10 using various techniques. As described above, in one preferred embodiment, the antenna element 20 is attached by means of the screws 30 and the threaded holes formed in the dielectric lens 10. In other embodiments, the antenna element 20 can be attached, e.g., by gluing the waveguide 21 to the surface 13 of the lens 10, by forcing the waveguide 21 against the lens 10 using mechanical fixtures, by screwing the waveguide 21 itself into a large threaded hole formed in the lens 10, or by screwing the waveguide 21 onto an externally threaded part of the lens 10.

Attachment of the dielectric insert 22 in the lens antenna 200 according to the invention in such position that at least one end of said insert is placed adjacent to the surface 13 of the lens 10 can also be performed by using various techniques. In one preferred embodiment, the lens 10 and the insert 22 in the waveguide 21 can be formed integrally, such that assembly of the antenna 200 and relative positioning of the elements are significantly simplified. In other embodiments, the insert 22 can be glued to the surface 13 of the lens 10 or attached by other means to the inner surface of the waveguide (e.g. pressed).

The effectiveness of lens antennas in various applications of millimeter wave radio communications is also defined by general availability of materials used in manufacturing of the lens. The primary requirement for lens materials is a low dielectric loss tangent value. For millimeter wave applications, the lens can be formed from materials including polypropylene, polystyrene, polyethylene, caprolon, polyamide, polycarbonate, polymethylpentene, polytetrafluorethylene, plexiglass, fused quartz, rexolite, high resistivity silicon, etc. The lens can be manufactured by injection molding, turning and machining, molding, etc.

In specific embodiments, the dielectric lens can be dyed for aesthetic purposes or to indicate certain information (e.g., the manufacturer logo) on the external surface thereof. In other embodiments, the lens can be covered with a radome for protection against snow, dust and other outside influences. Such radome can have various shapes and can be formed of standard materials (textolite, acrylonitrile-butadiene plastic, etc.) used to manufacture radomes for other aperture antennas (e.g. parabolic antennas, Cassegrain antennas, etc.).

Figure 4:
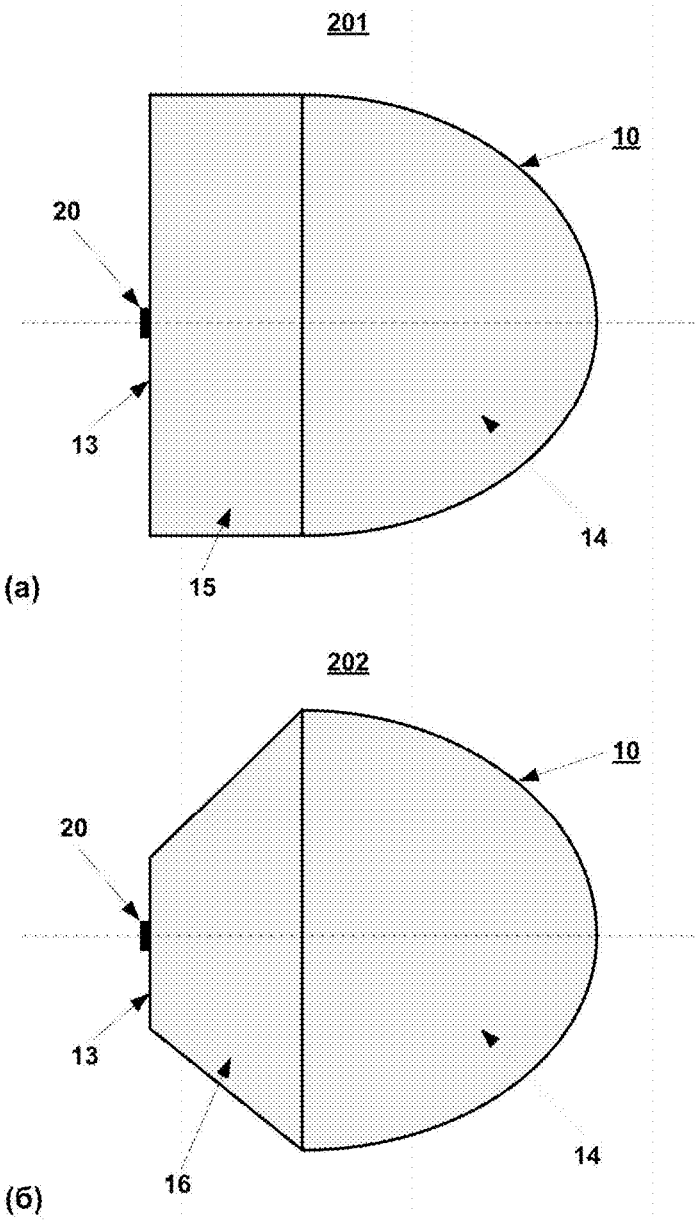
FIGS. 4*a,b* show various lens shapes in accordance with the present invention: a) an extension part having cylindrical shape, b) an extension part having truncated conical shape.

In a specific embodiment, the lens antenna 201 of FIG. 4*a* comprises a lens 10 and an antenna element 20. The lens 10 consists of a collimating part 14 and an extension part 15. The collimating part 14 has a shape of a hemiellipsoid and the extension part 15 has a cylindrical shape. The part 14 is integrally formed with the part 15, and the parts 14 and 15 of the lens 10 are made of a dielectric material. The extension part 15 of the lens 10 comprises a substantially flat surface 13, and the antenna element 20 is rigidly fixed on the surface 13. In this case, the eccentricity of the hemiellipsoid of the collimating part 14 of the lens 10 is inversely proportional to refraction index of the lens material, and thickness of the part 15 is equal to the focal length of the ellipsoid of the collimating part 14, which is required to provide the focusing properties of lens 10. Such shape is necessary for implementing antennas with diameter over 20× wavelength in free space. A deviation in lens shape from the shape described above leads to a significant decrease in directivity.

In another specific embodiment, a lens antenna 202 of FIG. 4*b* comprises a lens 10 and an antenna element 20. The lens 10 consists of a collimating part 14 and an extension part 16. The collimating part 14 has a shape of a hemiellipsoid and the extension part 16 has a truncated conical shape. The part 14 is integrally formed with the part 16, and the parts 14 and 16 of the lens 10 are made of a dielectric material. The part 16 comprises a substantially flat surface 13, and the antenna element 20 is rigidly fixed on the surface 13. The truncation of the conical part 16 allows reducing lens 10 weight without impairing electromagnetic properties, which is important in case of large-size antennas.

In yet another specific embodiment of the lens antenna, the extension part of the lens is formed by a certain surface of revolution for placing antenna elements on the surface positioned at an angle other than 90° to the axis of the lens.

In another embodiment, the collimating part of the lens may have a hemispherical shape. This lens shape is used when implementing lens antennas with diameter of less than 10×-20× wavelength in free space, and said shape in some cases provides a wider range of beam deviation in lens antennas. Further, the extension part of the lens can have a thickness less or more than the focal length of the lens to provide phase wave front that is close to uniform on an equivalent circular aperture of the lens.

The lens antenna 200 of FIG. 3 is operated as follows. A millimeter wave signal formed by a transmitter arrives to the non-radiating opening of the waveguide 21 of the antenna element 20. After the signal is propagated over the hollow waveguide 21, it is radiated into the body of the lens 10 through the radiating opening of the waveguide 21. The dielectric insert 22 provides radiation of the signal into the body of the lens 10 with reduced reflection coefficient. Due to radiation refraction effects on the lens/free space boundary, the lens 10 forms phase wave front that is close to flat on an equivalent circular aperture with amplitude distribution of electromagnetic field that is close to uniform. Therefore, a radiation pattern with narrow main beam is formed in the far region of the lens antenna 200 in a direction defined by the position of the antenna element 20 with respect to the axis of the lens 10. Upon receiving a signal from a certain direction, the lens 10 focuses all radiation in the area of the antenna element 20. The signal, thus received by the antenna element 20, passes from the radiating opening to the non-radiating opening through the hollow waveguide 21 and is input into a millimeter wave receiver.

Figure 5:
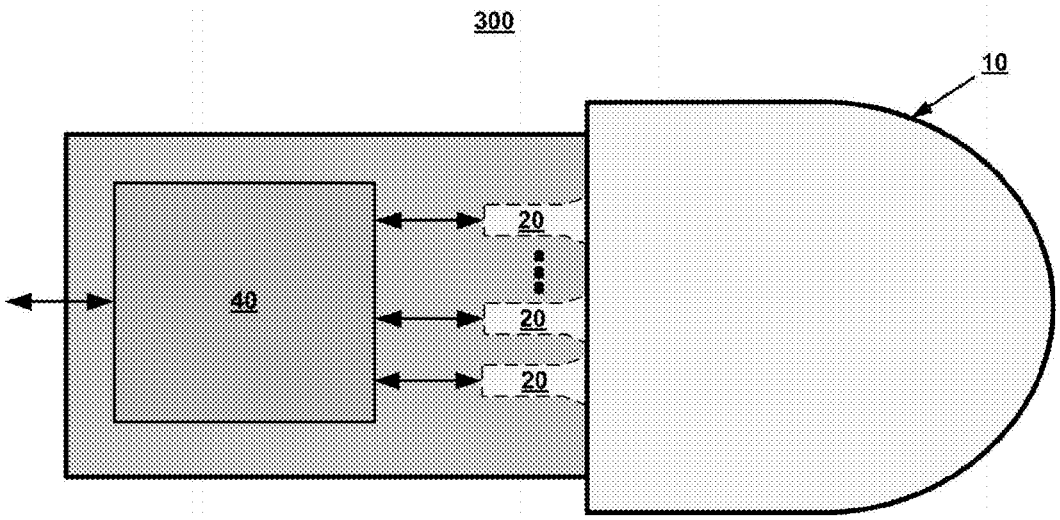
FIG. 5 shows the structure of a dielectric lens antenna with several primary antenna elements and a switching unit, which allows for electronic beam scanning.

FIG. 5 shows a lens antenna 300 in accordance with yet another embodiment. The lens antenna 300 comprises a dielectric lens 10, an array of primary antenna elements 20, and a switching unit 40. The lens 10 consists of a collimating part and an extension part, the collimating part and the extension part being formed integrally from a dielectric material, wherein the extension part comprises a substantially flat surface crossed by the axis of the collimating part. At least two antenna elements of the array are rigidly fixed on the surface of the lens 10, said antenna elements being formed by hollow waveguides, each of the antenna elements comprising a dielectric insert with one end thereof adjacent to said surface, and the size of the radiating openings of the waveguides is predetermined by the set shape and width values of the beams of the radiation pattern of the lens antenna. A switching unit 40 is used to feed one of the at least two antenna elements.

Due to the fact that the lens antenna 300 comprises at least two antenna elements 20, it is possible to use said antenna as a scanning antenna. Upon exciting, each of the antenna elements 20 placed at different distances from the axis of the lens 10, the lens 10 forms the main beam of the radiation pattern in a certain direction.

The lens antenna 300 comprising the antenna elements is operated as follows. A signal formed by a millimeter wavelength range transmitter arrives to the general port of the switching unit 40. Then the signal is propagated to one of the antenna elements 20 selected by the switching unit 40 based on, e.g., certain external low-frequency control signals. The selected antenna element radiates the signal in a way which is similar to radiating a signal in the lens antenna 200 having one antenna element 20, thus forming of a narrow beam of the radiation pattern by the lens 10, said beam having the direction defined by position of the antenna element 20. Said antenna element 20 also receives the signal from the direction corresponding to position of one antenna element 20 due to radiation focusing by means of the lens 10. The signal received by the antenna element 20 passes through the switching unit 40 to the input of a millimeter wave receiver.

The lens antenna according to any of the disclosed embodiments can be used in various millimeter wave radio communication applications, in particular in radio-relay point-to-point communication systems with frequency ranges of 57-66 GHz, 71-76/81-86 GHz, 92-95 GHz, in radars with frequency ranges of 77 GHz and 94 GHz, etc. In various embodiments, the antenna according to the invention can provide half-power beam width of less than 3° or less than 1° by implementing an aperture of corresponding size.

Figure 6:
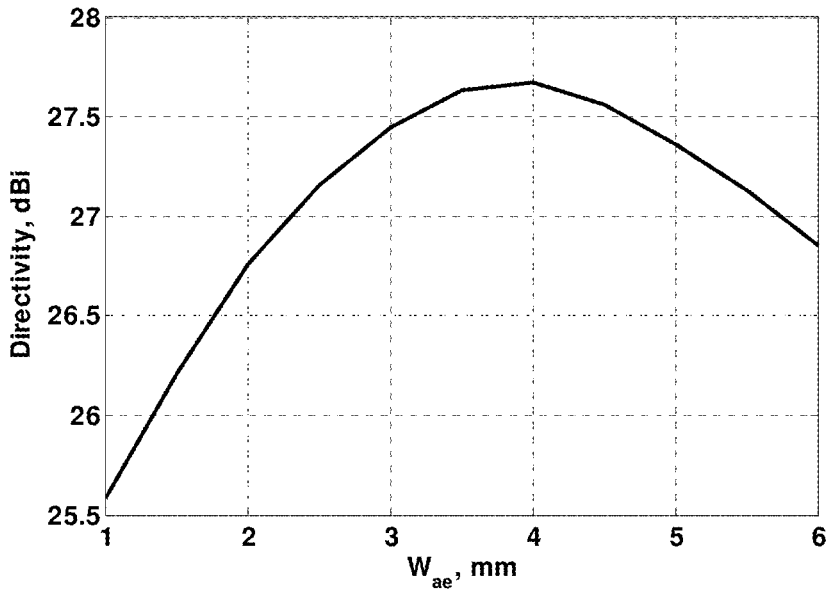
FIG. 6 shows the correlation of directivity from the size of the radiating opening of the waveguide for a polytetrafluorethylene lens ($\in$=2.1) having a diameter of 40 mm at a frequency of 60 GHz.

As an example illustrating the effectiveness of the disclosed lens antenna device, an electromagnetic simulations of a lens antenna according to the present invention was performed using a standard elliptic polytetrafluorethylene lens (dielectric constant $\in$=2.1) with a diameter of 40 mm at a frequency of 60 GHz (wavelength in free space $\lambda$=5 mm) The results of electromagnetic simulation of directivity of such lens antenna with a waveguide antenna element having a size of the radiating opening of 3.76 mm×Wae, depending on its width Wae (mm) are shown in FIG. 6. Variations with other radiating opening size provide similar results. It can be observed that the maximum directivity value is 27.6 dBi with Wae=3.8 mm The results show that by using an antenna element formed by a hollow waveguide placed on the lens surface within the lens focus, the achievable directivity value is very close to the theoretic threshold, which is 28.0 dBi for a circular aperture with a diameter of 40 mm.

When the size of the radiating opening of the radiating waveguide is changed, shape of the radiation pattern also changes. In particular, when increasing Wae in the above example, the width of the main beam of the radiation pattern increases, but the level of spillover radiation decreases. The combination of said two factors defines the maximum value on the curve shown in FIG. 6. Therefore, the above example shows that in lenses with the dielectric constant of about 2-2.5, the size of the radiating opening of the waveguide required to maximize the directivity is about 0.6$\lambda$-1.0$\lambda$. In the same way, it can be calculated that said size will be optimal for various shapes of the radiating openings.

When using materials with another dielectric constant value, a similar directivity behavior can be observed, the maximum value thereof provided at another point of Wae. When increasing lens diameter, the size of the radiating opening of the waveguide providing the maximum directivity value remains unchanged. This fact proves that the disclosed dielectric lens antenna device allows increasing directivity (and consequently, gain value) in lenses of any given diameter.

Figure 7:
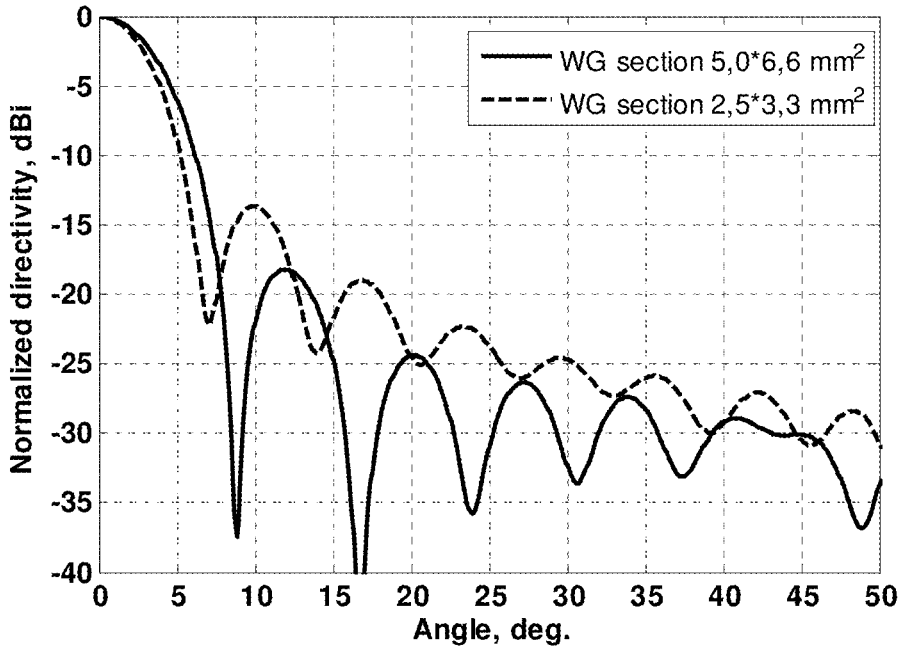
FIG. 7 shows cross-sections of electromagnetically simulated radiation patterns of a polytetrafluorethylene lens having a diameter of 40 mm at a frequency of 60 GHz with sizes of the radiating opening of the waveguide equal to 2.5×3.3 $mm^2$ and 5.0×6.6 $mm^2$.

As an example of dependence of the size of the radiating opening of the waveguide from the predefined width of the main lobe and by side lobe levels of the radiation pattern of the lens antenna, FIG. 7 shows cross-sections of radiation patterns of a polytetrafluorethylene elliptic lens antenna having a diameter of 40 mm at the frequency of 60 GHz with the size of the radiating opening of the waveguide of 2.5×3.3 $mm^2$ and 5.0×6.6 $mm^2$ FIG. 7 shows that the waveguide having the cross-section of 2.5×3.3 $mm^2$ provides a narrower main lobe of the radiation pattern with higher values of side lobe levels. This example shows that in order to provide a predetermined width of the main lobe and side lobe levels of the radiation pattern, a corresponding size of the radiating opening of the antenna element waveguide can be selected.

Figure 8:
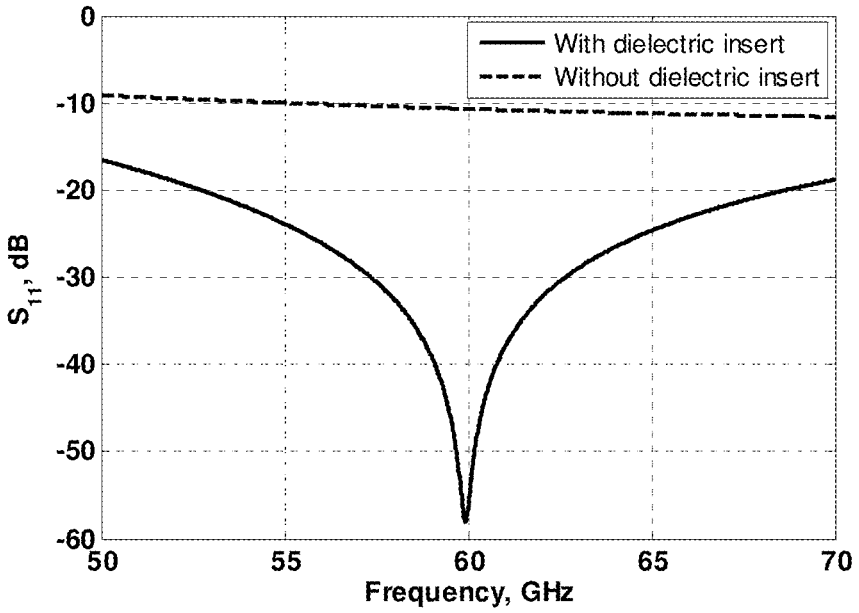
FIG. 8 shows the reflection coefficient of a polytetrafluorethylene lens antenna with and without the dielectric insert.

As an example showing the effectiveness of improving impedance matching level by using the disclosed dielectric insert, FIG. 8 shows the results of electromagnetic simulations of the reflection coefficient of a waveguide (without the dielectric insert and with a dielectric insert) having the cross-section of 3.76 mm×3.5 mm and radiating into a polytetrafluorethylene lens body. The results were obtained in the wide frequency range of 50-70 GHz. It can be noted that when the dielectric insert is not used, the reflection coefficient is about −10 dB, which leads to the insertion loss of 10% of the power delivered to the antenna by the power source. The improvement in impedance matching level is provided according to the present invention by means of a dielectric insert made of a polytetrafluorethylene material and having a rectangular cross-section of 3.5 mm×1.5 mm and thickness of 1.55 mm The results of electromagnetic simulations of the reflection coefficient in this case show that the dielectric insert allows reducing said coefficient to less than −16 dB over the whole band of 50 to 70 GHz, which leads to an increase in realized gain value of 8-10%.

The above example shows that the use of the lens antenna according to the invention allows increasing the gain value to values approaching the diffraction limit for aperture antennas.

Figure 9:
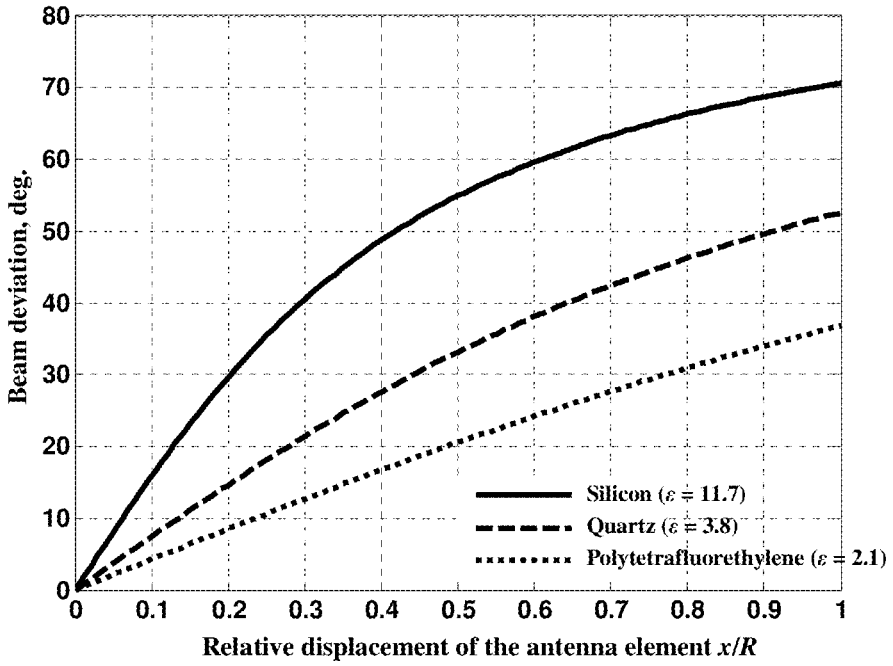
FIG. 9 shows the beam deviations of lenses made of silicon, quartz, and polytetrafluorethylene as function of different relative displacements of the primary antenna element from the axis of the lens.

Another practically important advantage is the possibility of beam direction control due to displacement of the antenna element on the lens surface. It is known that a displacement of the antenna element with respect to the lens axis causes the lens antenna beam to deviate for a certain angle depending on dielectric constant of the lens material. For example, FIG. 9 shows the beam deviation by lenses made of silicon, quartz and polytetrafluorethylene for different relative displacements of the antenna element from the lens axis.

In antennas according to the invention, the beam can be directed in a controlled manner because the waveguide and the dielectric insert can be arranged on the flat surface of the lens with arbitrarily offset from the lens axis.

The present invention is not limited to the specific embodiments described in the present disclosure; the invention encompasses all modifications and variations without departing from the spirit and scope of the invention set forth in the accompanying claims.

The invention claimed is:

1. A lens antenna comprising: a lens and an antenna element, the lens including a collimating part and an extension part, the collimating part and the extension part being formed integrally from a dielectric material, and the extension part having the thickness substantially equal to the focal length of the collimating part of the lens, wherein the extension part comprises a substantially flat surface crossed by an axis of the collimating part; wherein the antenna element is rigidly fixed on said surface, said antenna element is formed by a hollow radiating waveguide with a radiating opening having a size between 0.6λ to 1.0λ, where λ is the wavelength in free space, and facing the lens, wherein the hollow radiating waveguide comprises a transition segment between an input aperture of the hollow radiating waveguide and the radiating opening of the hollow radiating waveguide, the transition segment having a variable cross-section; and the antenna element comprises a dielectric insert having the same cross-section shape as the radiating opening, wherein the dielectric insert and the lens are formed of the same dielectric material, and the dielectric insert is formed integrally with the lens.

2. The lens antenna according to claim 1, wherein the radiating opening of the hollow radiating waveguide is configured such that its size defines a beamwidth value of a main radiation pattern lobe of the lens antenna.

3. The lens antenna according to claim 1, wherein the antenna element is fixed in a position relatively to the lens axis determined in accordance with a predefined direction of a main radiation pattern lobe of the lens antenna.

4. The lens antenna according to claim 1, wherein the dielectric insert has a length which is less than a hollow radiating waveguide length.

5. The lens antenna according to claim 1, wherein the radiating opening of the hollow radiating waveguide has a rectangular shape.

6. The lens antenna according to claim 1, wherein the radiating opening of the hollow radiating waveguide has a circular shape.

7. The lens antenna according to claim 1, wherein the radiating opening of the hollow radiating waveguide has an elliptic shape.

8. The lens antenna according to claim 1, wherein the lens is made of the dielectric material with a dielectric constant ranging from 2.0 to 2.5.

9. The lens antenna according to claim 1, wherein the collimating part of the lens has a shape of a hemi-ellipsoid of revolution.

10. The lens antenna according to claim 1, wherein the collimating part of the lens has a hemispherical shape.

11. The lens antenna according to claim 1, wherein the surface of the extension part is a surface of revolution.

12. The lens antenna according to claim 11, wherein the extension part has a cylindrical shape.

13. The lens antenna according to claim 11, wherein the extension part has a truncated conical shape.

14. The lens antenna according to claim 1, wherein the input aperture of the hollow radiating waveguide is connected to a transceiver.

15. The lens antenna according to claim 1, adapted for use in millimeter wave point-to-point radio communication systems.

16. A lens antenna comprising: a lens and at least two antenna elements, the lens including a collimating part and an extension part, the collimating part and the extension part being formed integrally from a dielectric material, and the extension part having the thickness substantially equal to the focal length of the collimating part of the lens, wherein the extension part comprises a substantially flat surface crossed by an axis of the collimating part; wherein the at least two antenna elements are rigidly fixed on said surface, said the at least two antenna elements are formed by hollow radiating waveguides with radiating openings having a size between 0.6λ to 1.0λ, where λ is the wavelength in free space, and facing the lens, wherein each of the hollow radiating waveguides comprises a transition segment between an input aperture of the hollow radiating waveguide and a radiating opening of the hollow radiating waveguide, the transition segment having a variable cross-section, and each of the at least two antenna elements comprises a dielectric insert having the same cross-section shape as its radiating opening, wherein the dielectric insert and the lens are formed of the same dielectric material, and the dielectric insert is formed integrally with the lens.

17. The lens antenna according to claim 16, further comprising a switching unit for supplying a signal to one of the at least two antenna elements.

18. The lens antenna according to claim 16, adapted for use in millimeter wave point-to-point radio communication systems.

* * * * *